US011361921B2

(12) United States Patent
Breder et al.

(10) Patent No.: US 11,361,921 B2
(45) Date of Patent: Jun. 14, 2022

(54) BREAKING DEVICE

(71) Applicant: ABB S.p.A., Milan (IT)

(72) Inventors: Henrik Breder, Västerås (SE); Marley Becerra, Västerås (SE); James Mannekutla, Västerås (SE); Alessio Bergamini, Gazzaniga (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 17/436,855

(22) PCT Filed: Feb. 17, 2020

(86) PCT No.: PCT/EP2020/054121

§ 371 (c)(1),
(2) Date: Sep. 7, 2021

(87) PCT Pub. No.: WO2020/182421

PCT Pub. Date: Sep. 17, 2020

(65) Prior Publication Data

US 2022/0102093 A1 Mar. 31, 2022

(30) Foreign Application Priority Data

Mar. 13, 2019 (EP) ..... 19162584

(51) Int. Cl.
*H01H 9/32* (2006.01)
*H01H 9/34* (2006.01)
*H01H 33/06* (2006.01)

(52) U.S. Cl.
CPC ..... *H01H 33/06* (2013.01); *H01H 9/32* (2013.01); *H01H 9/342* (2013.01)

(58) Field of Classification Search
CPC ..... H01H 33/06; H01H 33/04; H01H 33/08; H01H 33/10; H01H 33/121;
(Continued)

(56) References Cited

U.S. PATENT DOCUMENTS 3,140,374 A * 7/1964 Cole ..... H01H 33/75 218/103
3,356,811 A * 12/1967 Cushing ..... H01H 33/75 218/103

(Continued)

FOREIGN PATENT DOCUMENTS

CN 107887208 A 4/2018
DE 2829860 A1 1/1980

(Continued)

OTHER PUBLICATIONS

Extended European Search Report; Application No. 19162584.7; Completed: Sep. 10, 2019; dated Sep. 24, 2019; 7 Pages.

(Continued)

*Primary Examiner* — William A Bolton
(74) *Attorney, Agent, or Firm* — Whitmyer IP Group LLC

(57) ABSTRACT

A breaking device for interrupting current, the breaking device including an electrically conducting outer member; an electrically conducting inner member arranged radially inside the outer member with respect to a breaking axis; and an electrically insulating or semiconducting breaking tube arranged radially between the outer member and the inner member with respect to the breaking axis, the breaking tube being arranged to move along the breaking axis from a starting position to a protruding position in which the breaking tube protrudes from a space within the outer member for interrupting a current between the outer member and the inner member by means of the breaking tube.

19 Claims, 7 Drawing Sheets

(58) Field of Classification Search
CPC .... H01H 2033/085; H01H 9/32; H01H 9/342; H01H 9/341; H01H 9/36
USPC ..... 218/1, 2, 12, 15, 34, 38, 46, 76, 79, 80, 218/81, 100, 103
See application file for complete search history.

(56) References Cited

U.S. PATENT DOCUMENTS 3,425,017 A 1/1969 Schockelt
4,260,214 A 4/1981 Dorn
4,295,021 A * 10/1981 Asinovsky ..... H01H 85/38 218/37
4,458,121 A * 7/1984 Yanabu ..... H01H 33/703 218/115
4,562,323 A 12/1985 Belbel et al.
5,006,679 A * 4/1991 Thornton ..... H01H 39/004 218/1
5,616,898 A * 4/1997 Maineult ..... H01H 33/10 218/156
2015/0014279 A1 1/2015 Rodrigues et al.
2018/0350546 A1* 12/2018 Breder ..... H01H 3/166

FOREIGN PATENT DOCUMENTS

GB 1201100 A 8/1970
WO 2017141197 A1 8/2017

OTHER PUBLICATIONS

International Preliminary Report on Patentability; Application No. PCT/EP2020/054121; dated May 25, 2020; 12 Pages.
International Search Report and Written Opinion of the International Searching Authority; Application No. PCT/EP2020/054121; Completed: Apr. 3, 2020; dated Apr. 20, 2020; 13 Pages.
Chinese Office Action; Application No. 202080020017.1; dated Dec. 30, 2021; 9 Pages.

* cited by examiner

BREAKING DEVICE

TECHNICAL FIELD

The present disclosure generally relates to breaking devices. In particular, a breaking device for interrupting current, is provided.

BACKGROUND

Traditional breaking devices open up a gap between two contacts while an ignited arc is extinguished by building up a voltage. In some types of breaking devices, an arc between separated contacts is guided to a stacked arrangement of a plurality of splitter plates located inside an arcing chamber. The splitter plates are typically arranged substantially parallel to each other and a space is formed in between each pair of adjacent splitter plates. The arcing chamber may be filled with air, gas or other fluid.

When the arc is ignited, the arc impacts on the edges of the splitter plates and is split in several arc segments. Ideally, the arc enters the splitter plates, and the arc segments stay within the splitter plate region until the current is interrupted. Then, the arc is extinguished.

U.S. Pat. No. 4,562,323 A discloses a switch device comprising means for controlling the separation of the contacts and for inserting an electrically insulating screen between the contacts during opening thereof. The screen cooperates with an electrically insulating surface formed by a wall of a substantially closed arc chamber, for shearing the arc between the contacts.

GB 1201100 A discloses an electric switch comprising a cluster of resilient contacts, a fixed cylindrical contact and an annulus of insulating material movable in an axial direction to separate the fixed and resilient contacts.

U.S. Pat. No. 3,425,017 A discloses a current sensor comprising contact fingers, an inwardly extending annular contact portion, a metallic tension tube and an internal layer of insulation formed at one end of a metallic tension tube.

SUMMARY

One object of the present disclosure is to provide a breaking device for interrupting current, which breaking device has a high fault current breaking capacity.

A further object of the present disclosure is to provide a breaking device for interrupting current, which breaking device provides a fast interruption of current.

A further object of the present disclosure is to provide a breaking device for interrupting current, which breaking device provides a reliable interruption of current.

A still further object of the present disclosure is to provide a breaking device for interrupting current, which breaking device is compact.

A still further object of the present disclosure is to provide a breaking device for interrupting current, which breaking device is cheap.

A still further object of the present disclosure is to provide a breaking device for interrupting current, which breaking device can operate over wide voltage ranges.

A still further object of the present disclosure is to provide a breaking device for interrupting current, which breaking device can effectively reduce a risk of sustaining arcs, e.g. prevent re-ignition.

A still further object of the present disclosure is to provide a breaking device for interrupting current, which breaking device can be used multiple times to interrupt current.

A still further object of the present disclosure is to provide a breaking device for interrupting current, which breaking device solves several or all of the foregoing objects in combination.

According to one aspect, there is provided a breaking device for interrupting current, the breaking device comprising an electrically conducting outer member; an electrically conducting inner member arranged radially inside the outer member with respect to a breaking axis; and an electrically insulating or semiconducting breaking tube arranged radially between the outer member and the inner member with respect to the breaking axis, the breaking tube being arranged to move along the breaking axis from a starting position to a protruding position in which the breaking tube protrudes from a space within the outer member for interrupting a current between the outer member and the inner member by means of the breaking tube.

Although the inner member is arranged radially inside the outer member with respect to the breaking axis, the inner member may or may not be aligned with the outer member along the breaking axis. That is, the inner member may or may not be arranged within the outer member.

In case the inner member is arranged within the outer member, the space may be formed between the outer member and the inner member. In case the outer member and the inner member are offset along the breaking axis, the space may be formed within the outer member. In any case, the inner member is arranged radially between the outer member and the inner member with respect to the breaking axis.

The breaking tube provides an electrical potential barrier between the outer member and the inner member. Due to the tubular shape of the breaking tube, the arc can be effectively trapped by movement of the breaking tube from the starting position to the protruding position.

As the breaking tube moves from the starting position, an arc path between the inner member and the outer member is lengthened. When the breaking tube has started to move from the starting position, the breaking tube forces the arc to pass from the inner member, over the protruding end of the breaking tube, and to the outer member. The breaking tube thus extends the length of the arc when moving from the starting position. The arc is thereby stressed by the movement of the breaking tube from the starting position. The extended length of the arc path eventually causes the arc to be extinguished. Thereby, a circuit comprising the breaking device can be opened. The starting position and the protruding position of the breaking tube may thus correspond to a closed position and an open position, respectively, of the breaking device.

In case the inner member is arranged within the outer member, the breaking tube forces the arc to extend over at least the double length of the axial transition of the breaking tube from the starting position along the breaking axis. The breaking device can thereby provide interruption of the current by a particularly effective extension of the arc. The extension is effective since when the breaking tube moves from the starting position along the breaking axis over a breaking tube distance, an arc path between the outer member and the inner member is extended with a distance of at least twice the breaking tube distance. Thereby, voltage can be built up fast.

The breaking device can thus break or interrupt current by protrusion of the breaking tube and a consequential extension of the arc path. Exactly at which position of the breaking tube along the breaking axis the arc is extinguished depends on the specific configuration of the breaking device and the applied current and voltage. The breaking tube does not have to move all the way, e.g. against an end section, to break the current. The protruding position may be a position where the breaking tube protrudes from the space such that an arc path between the outer member and the inner member, over the protruding part of the breaking tube, is extended such that the arc is extinguished.

Since the breaking device comprises a breaking tube, the breaking device constitutes a tubular breaker. The breaking device may be used for AC and DC applications, e.g. in low voltage and medium voltage ranges. The breaking device may be active or passive (i.e. not requiring auxiliary power other than from an applied circuit source). The breaking device according to the present disclosure may for example be implemented as a switching device, a power device, a commutation switch, a disconnector, a passive DC breaker, a passive AC breaker, a load switch or a current limiter.

The breaking tube may further be arranged to move back along the breaking axis from the protruding position to the starting position. The breaking device may be configured to interrupt current multiple times.

The breaking tube may for example be made of POM (polyoxymethylene) or other plastic material. Alternatively, the breaking tube may be made of zinc oxide. The breaking tube may be electrically insulating or semiconducting, but not electrically conducting.

The inner member may be connected to an inner electrical contact of an electrical circuit and the outer member may be connected to an outer electrical contact of the electrical circuit. The outer member and the inner member may be of various shapes, for example tubes, bars or rods. The outer member and the inner member may be of the same type of shape or of different types of shapes.

The outer member and/or the inner member may be an electrically conducting tube. According to one example, each of the outer member and the inner member is an electrically conducting tube.

The outer member, the inner member and the breaking tube may be substantially concentric, or concentric, with the breaking axis. In this case, a triaxial breaking device is formed.

According to one example, the outer member comprises an outer member end and the inner member comprises an inner member end, the inner member is arranged within the outer member, and the outer member end and the inner member end are substantially aligned, or aligned along the breaking axis. In this case, the breaking tube may extend beyond the outer member end and the inner member end along the breaking axis in the protruding position.

The breaking device may further comprise an actuator arranged to force the breaking tube from the starting position to the protruding position. The actuator may for example be a linear actuator or a ballistic actuator, such as a Thomson drive. In any case, the actuator may for example be electromagnetic or pneumatic. A linear actuator continuously controls the movement of the breaking tube while a ballistic actuator provides a ballistic movement of the breaking tube. A fast actuation of the breaking tube provides a fast voltage increase and improves the performance of the breaking device.

The breaking device may further comprise an arcing chamber, and the breaking tube may be arranged to be positioned at least partly inside the arcing chamber in the protruding position. The arcing chamber may be filled with air, gas or other fluid.

Each of the outer member end and the inner member end may adjoin a volume within the arcing chamber. Thereby, when the breaking tube moves into the arcing chamber, the arc has nowhere to escape.

The breaking device may further comprise at least one arc restricting member arranged within the arcing chamber. Alternatively, the breaking device may not comprise any arc restricting member at all.

The breaking tube may be arranged to move past the at least one arc restricting member by moving along the breaking axis from the starting position to the protruding position. In this way, the arc can be forced to the at least one arc restricting member.

The at least one arc restricting member may be positioned radially outside and/or radially inside the breaking tube with respect to the breaking axis when the breaking tube is in the protruding position. Each arc restricting member positioned radially inside the breaking tube, such as an inner splitter plate, may comprise one or more through holes.

The at least one arc restricting member may comprise at least one splitter plate and/or at least one arc cooling body, such as a plate or hollow body made of an outgassing material. The at least one splitter plate may be made of metal or steel.

According to one example, the breaking device comprises a plurality of splitter plates arranged in a stack within the arcing chamber. The splitter plates may be outer splitter plates, i.e. radially outside (with respect to the breaking axis) the breaking tube. Alternatively, or in addition, the splitter plates may be inner splitter plates, i.e. radially inside (with respect to the breaking axis) the breaking tube.

According to an alternative variant, the arcing chamber may be empty, i.e. not comprising any arc restricting member. A breaking device without splitter plates, or without any arc restricting member, can also interrupt a current between the outer member and the inner member.

The arcing chamber may further comprise at least one vent opening for venting a volume within the arcing chamber when the breaking tube has moved from the starting position. The at least one vent opening may for example be constituted by through holes and/or through slots. The venting through the at least one vent opening takes places as soon as the breaking tube starts to move from the starting position.

The at least one vent opening may comprise at least one axial vent opening for venting a volume within the arcing chamber and within the breaking tube when the breaking tube has moved from the starting position. Alternatively, or in addition, the at least one vent opening may comprise at least one radial vent opening for venting a volume within the arcing chamber and outside the breaking tube when the breaking tube has moved from the starting position.

The breaking device may further comprise an end section, and the breaking tube may be arranged to be seated against the end section in the protruding position. The end section may delimit the arcing chamber. When the breaking tube is seated against the end section, there is no way for the arc to escape and any residual current is chopped. The seating of the breaking tube against the end section provides an arc quenching effect. A breaking tube arranged to be seated against the end section in the protruding position enables a more compact design of the arcing chamber or a use without a dedicated arcing chamber.

The end section may comprise a seal. The tip of the breaking tube can thereby be sealingly received in the seal of the end section. Alternatively, the breaking tube simply hits the end section.

The end section may comprise a slot for receiving the breaking tube in the protruding position. The slot and the tip of the breaking tube may be designed such that the breaking tube does not bounce in the slot. Thereby, any occurrence of residual currents can be reliably prevented. For example, the shape of the slot and the tip of the breaking tube may be substantially matching, or matching, e.g. each having a tapered shape or a curved shape.

The end section may be electrically insulating. Alternatively, the end section may be semiconducting or electrically conducting. The end section may for example be made of an insulating ablating material, POM or other plastic material.

The breaking device may further comprise a contact arrangement configured to selectively electrically disconnect the outer member and the inner member. The contact arrangement may for example comprise one or more contact fingers. When the contact arrangement electrically disconnects the outer member and the inner member, an arc is ignited between the outer member and the inner member.

The operation of the contact arrangement may be linked with the movement of the breaking tube, either mechanically linked with the breaking tube (e.g. directly or via a linkage), mechanically linked with the actuator, or linked by means of a simultaneous control of the breaking tube and the contact arrangement.

The contact arrangement may be configured to electrically disconnect the outer member and the inner member during movement of the breaking tube from the starting position towards the protruding position. The breaking tube may push, or otherwise actuate, the contact arrangement when moving from the starting position towards the protruding position, to electrically disconnect the outer member and the inner member. In this case, the breaking tube thus functions as an opening tube. One example of such contact arrangement is a crown-type contact which is automatically opened by penetration of the breaking tube.

Alternatively, the contact arrangement can be actuated in other ways at the same time as the travel of the breaking tube is initiated. That is, the contact arrangement does not necessarily have to be actuated by movement of the breaking tube. Rather, the contact arrangement can be provided separately and synchronized with the operation of the breaking tube.

The contact arrangement may provide an electrical connection at various different points of the outer member and the inner member. For example, the contact arrangement may provide an electrical connection between the outer member end and the inner member end prior to the electrical disconnection.

BRIEF DESCRIPTION OF THE DRAWINGS

Further details, advantages and aspects of the present disclosure will become apparent from the following embodiments taken in conjunction with the drawings, wherein.

DETAILED DESCRIPTION

Figure 1:
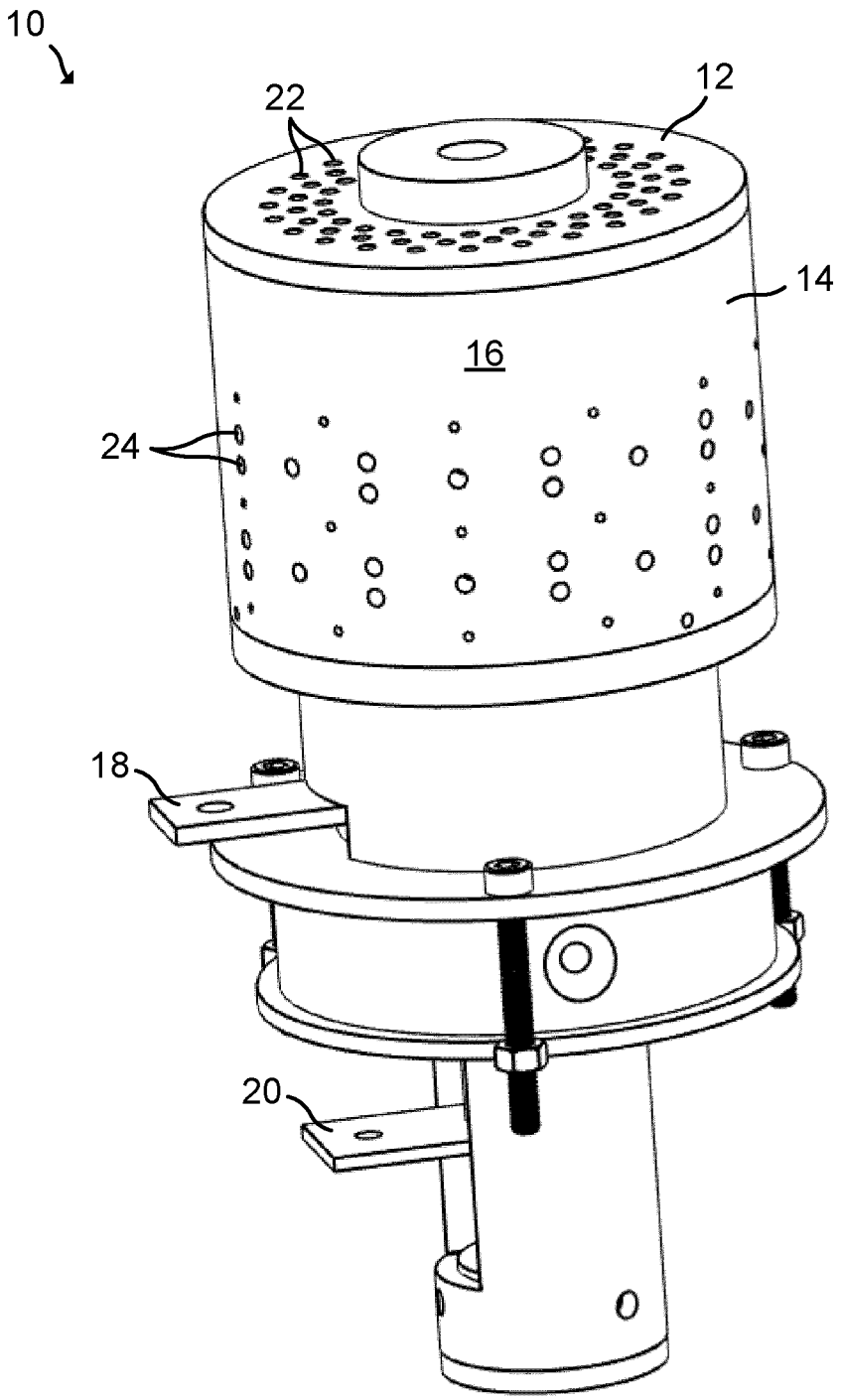
FIG. 1: schematically represents a perspective view of a breaking device.

In the following, a breaking device for interrupting current will be described. The same reference numerals will be used to denote the same or similar structural features.

FIG. 1 schematically represents a perspective view of a breaking device 10 configured to interrupt current. The breaking device 10 may be used for AC and DC applications, e.g. in low voltage and medium voltage ranges.

The breaking device 10 of this example comprises an end section 12 and a wall 14 forming an arcing chamber 16. The breaking device 10 further comprises an outer electrical contact 18 and an inner electrical contact 20. A plurality of axial vent openings 22 are formed in the end section 12 and a plurality of radial vent openings 24 are formed in the wall 14. The end section 12 and the wall 14 may for example be made of an electrically insulating material, such as POM and/or poly(methyl methacrylate) (PMMA).

Figure 2:
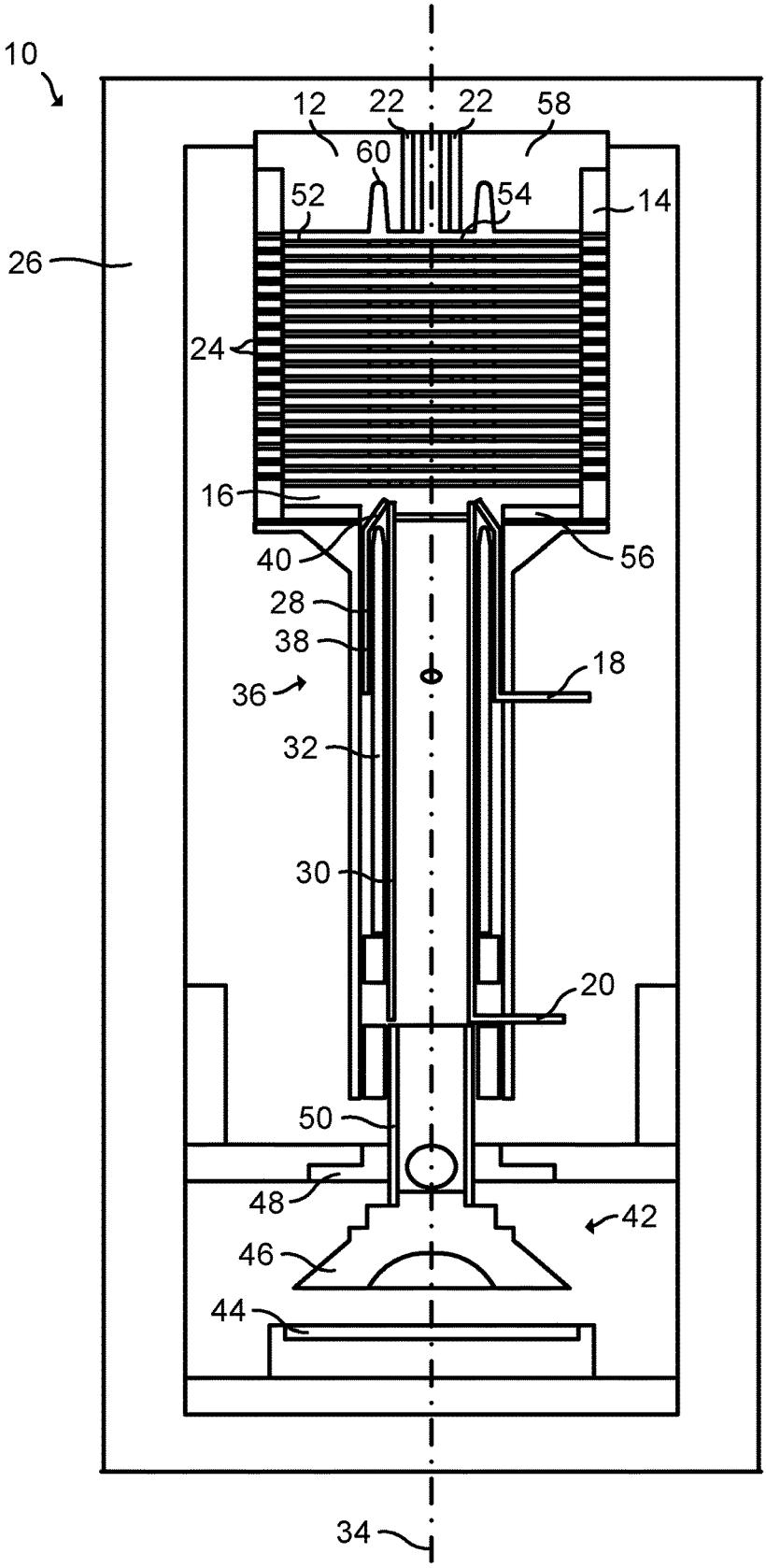
FIG. 2: schematically represents a cross-sectional side view of the breaking device in FIG. 1.

FIG. 2 schematically represents a cross-sectional side view of the breaking device 10 in FIG. 1. In FIG. 2, the breaking device 10 is arranged within an outer housing 26. The arcing chamber 16 may be filled with air, gas or other fluid.

The breaking device 10 comprises an electrically conducting outer member 28, an electrically conducting inner member 30 and a breaking tube 32. The breaking device 10 may therefore be referred to as a tubular breaker. The breaking tube 32 can be made of either an insulating material, such as POM or other plastic material, or a semiconducting material. The breaking tube 32 of this example has a circular cross-section.

The breaking tube 32 is concentric with a breaking axis 34. In FIG. 2, the breaking tube 32 is in a starting position 36. The breaking tube 32 is configured to move from the starting position 36 along the breaking axis 34 (upwards in FIG. 2).

The inner member 30 is arranged radially inside the outer member 28 with respect to the breaking axis 34. The breaking tube 32 is arranged radially between the outer member 28 and the inner member 30 with respect to the breaking axis 34. A space 38 is defined within the outer member 28 and the breaking tube 32 is arranged in this space 38 in the starting position 36.

As shown in FIG. 2, the outer member 28 is connected to the outer electrical contact 18 and the inner member 30 is connected to the inner electrical contact 20. The breaking device 10 further comprises a contact arrangement 40. The contact arrangement 40 is configured to selectively electrically disconnect the outer member 28 and the inner member 30.

In this example, each of the outer member 28 and the inner member 30 is an electrically conducting tube concentric with the breaking axis 34. Each of the outer member 28 and the inner member 30 has a circular cross-section. The breaking device 10 in FIG. 2 is thus a triaxial breaking device. One or both of the outer member 28 and the inner member 30 may however adopt shapes other than tubes.

The breaking device 10 further comprises an actuator 42. The actuator 42 may be of various types in order to force the breaking tube 32 away from the starting position 36. In FIG. 2, the actuator 42 is exemplified as a ballistic actuator in the form of a Thomson drive. The actuator 42 comprises a Thomson coil 44, an armature 46, an armature relaxing cushion 48, and an actuator tube 50. The Thomson coil 44 and the armature 46 are arranged to provide energy to a ballistic movement of the breaking tube 32.

The breaking device 10 further comprises a plurality of splitter plates 52, 54. The splitter plates 52, 54 constitute examples of arc restricting members according to the present disclosure. The breaking device 10 may comprise additional types of arc restricting members, alternative types of arc restricting member, or no arc restricting members at all.

The breaking device 10 further comprises a base section 56. The end section 12, the wall 14 and the base section 56 delimit the arcing chamber 16.

Each of the axial vent openings 22 and the radial vent openings 24 are constituted by through holes. The axial vent openings 22 extend from the interior of the arcing chamber 16 and through the end section 12. The radial vent openings 24 extend from the interior of the arcing chamber 16 and through the wall 14. The vent openings 22, 24 are configured to vent the volume within the arcing chamber 16 when the breaking tube 32 starts to move from the starting position 36.

The end section 12 of this example further comprises a seal 58 and a slot 60 formed in the seal 58. The slot 60 is annular and concentric with respect to the breaking axis 34.

Figure 3:
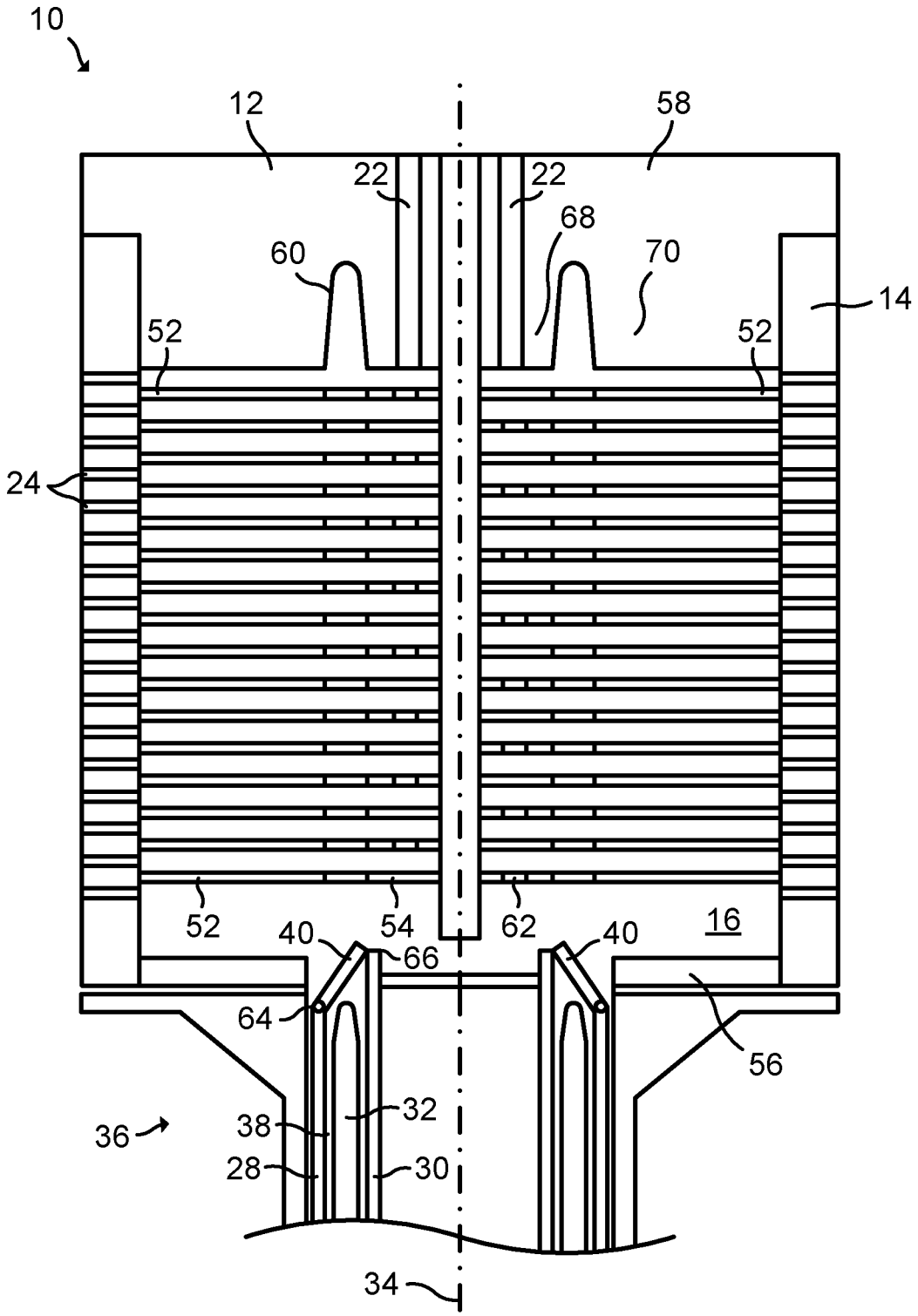
FIG. 3: schematically represents an enlarged partial view of the breaking device in FIG. 2 with a breaking tube in a starting position.

FIG. 3 schematically represents an enlarged partial view of the breaking device 10 in FIG. 2. The breaking device 10 comprises outer splitter plates 52 and inner splitter plates 54. All splitter plates 52, 54 are coaxially arranged with respect to the breaking axis 34. Each inner splitter plate 54 comprises a through hole 62.

The splitter plates 52, 54 may be made of metal or steel. The splitter plates 52, 54 are arranged in a stack within the arcing chamber 16. The number and configuration of the splitter plates 52, 54 may however be varied.

As shown in FIG. 3, the outer member 28 and the inner member 30 are generally aligned along the breaking axis 34. Thus, the inner member 30 is not only arranged radially inside the outer member 28, but also arranged within the outer member 28. In this example, the space 38 is thus defined between the outer member 28 and the inner member 30.

The outer member 28 comprises an outer member end 64 and the inner member 30 comprises an inner member end 66. The outer member end 64 and the inner member end 66 are generally aligned along the breaking axis 34. Each of the outer member end 64 and the inner member end 66 are positioned adjacent to the arcing chamber 16. The contact arrangement 40 of this example comprises a plurality of electrically conducting fingers hinged to the outer member end 64.

Furthermore, as shown in FIG. 3, the slot 60 forms a plug 68 and a cylinder 70 in the end section 12. In this example, the lower ends of the plug 68 and cylinder 70 are flush. However, the plug 68 may alternatively extend below the cylinder 70 into the arcing chamber 16.

Figure 4:
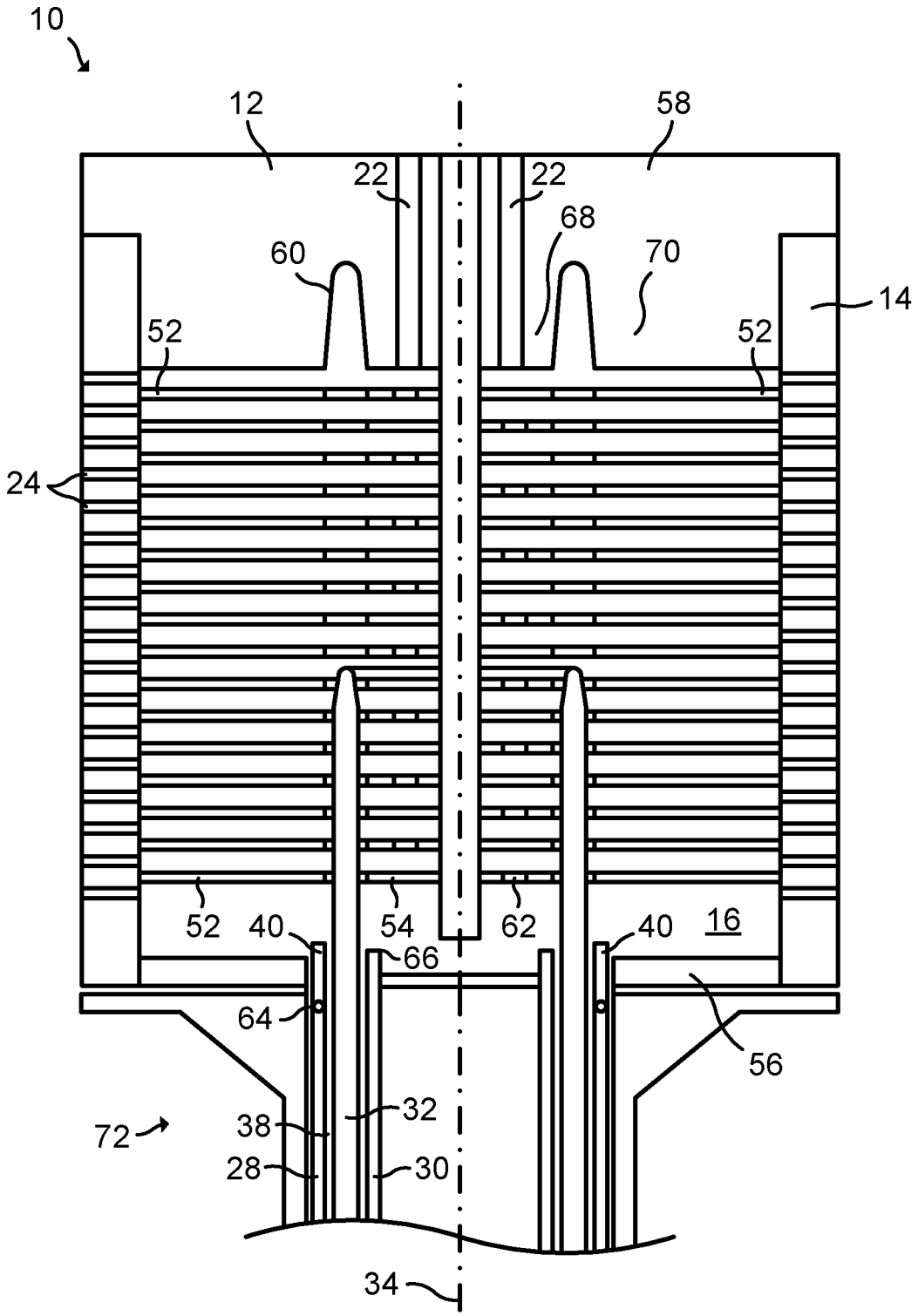
FIG. 4: schematically represents an enlarged partial view of the breaking device in FIG. 2 with the breaking tube in a protruding position.

FIG. 4 schematically represents an enlarged partial view of the breaking device 10 in FIG. 2 with the breaking tube 32 in a protruding position 72. The breaking tube 32 has thus moved, by means of the actuator 42, from the starting position 36 in FIGS. 2 and 3 along the breaking axis 34 to the protruding position 72 illustrated in FIG. 4 where the breaking tube 32 protrudes into the arcing chamber 16.

During the movement of the breaking tube 32 from the starting position 36 to the protruding position 72 in FIG. 4, the breaking tube 32 pushes the contact arrangement 40 from the electrically connected state in FIGS. 2 and 3 into the electrically disconnected state in FIG. 4. The outer member 28 is thereby electrically disconnected from the inner member 30 and an arc is ignited between the outer member 28 and the inner member 30. The use of the breaking tube 32 as a "pushing tube" according to FIG. 4 is however only one of several ways to electrically disconnect the outer member 28 and the inner member 30 by means of the contact arrangement 40.

Already when the tip of the breaking tube 32 has moved into the arcing chamber 16, but has not yet reached the splitter plates 52, 54, the breaking tube 32 can interrupt so-called critical currents (i.e. currents much lower than the rated current). In standard designs, critical current arcs may not reach the splitter plate package.

The arc generates an overpressure within the arcing chamber 16. The overpressure is released by means of the vent openings 22, 24. Furthermore, venting of the arcing chamber 16 through the vent openings 22, 24 takes place immediately when the breaking tube 32 starts to move.

The breaking tube 32 moves radially outside of the inner splitter plates 54 and radially inside of the outer splitter plates 52. The splitter plates 52, 54 build up a series of anode-cathode voltage steps as the arc connects through the splitter plates 52, 54. As the breaking tube 32 moves into the arcing chamber 16, the arc is split between the splitter plates 52 outside of the breaking tube 32 and the splitter plates 54 inside the breaking tube 32. The splitter plates 52, 54 thereby trap and cool the arc.

In the protruding position 72 in FIG. 4, the breaking tube 32 protrudes from the space 38 within the outer member 28 and forms an electrical potential barrier between the outer member 28 and the inner member 30. The breaking tube 32 extends beyond (upwards in FIG. 4) the outer member end 64 and the inner member end 66.

The arc is forced to move from the inner member 30, over the protruding end of the breaking tube 32, and back to the outer member 28. The breaking tube 32 thereby lengthens the arc path between the outer member 28 and the inner member 30 and forces the arc to pass over this extended length.

As can be gathered from FIG. 4, the distance of arc path is increased at least twice as fast as the movement speed of breaking tube 32. That is, the breaking tube 32 forces the arc to extend over at least the double length of the axial transition of the breaking tube 32 from the starting position 36 to the protruding position 72. In some implementations, this stressing of the arc in the protruding position 72 in FIG. 4 causes the arc to be extinguished. The protruding position 72 in FIG. 4 thereby constitutes one position of the breaking tube 32 for interrupting a current between the outer member 28 and the inner member 30 by means of the breaking tube 32.

The through holes 62 of the inner splitter plates 54 allow escape of gas within the breaking tube 32 and a consequential pressure release. The radial vent openings 24 allow for gas to flow out from the arcing chamber 16 and distribute the arc voltage axially between the splitter plates 52, 54. The concentricity of the splitter plates 52, 54 with respect to the breaking axis 34 facilitates forming the arc into the splitter plates 52, 54. The through holes 62 in the splitter plates 54, the radial vent openings 24 and the axial vent openings 22 thus allow the arc to move and to avoid excessive pressure inside the arcing chamber 16.

Figure 5:
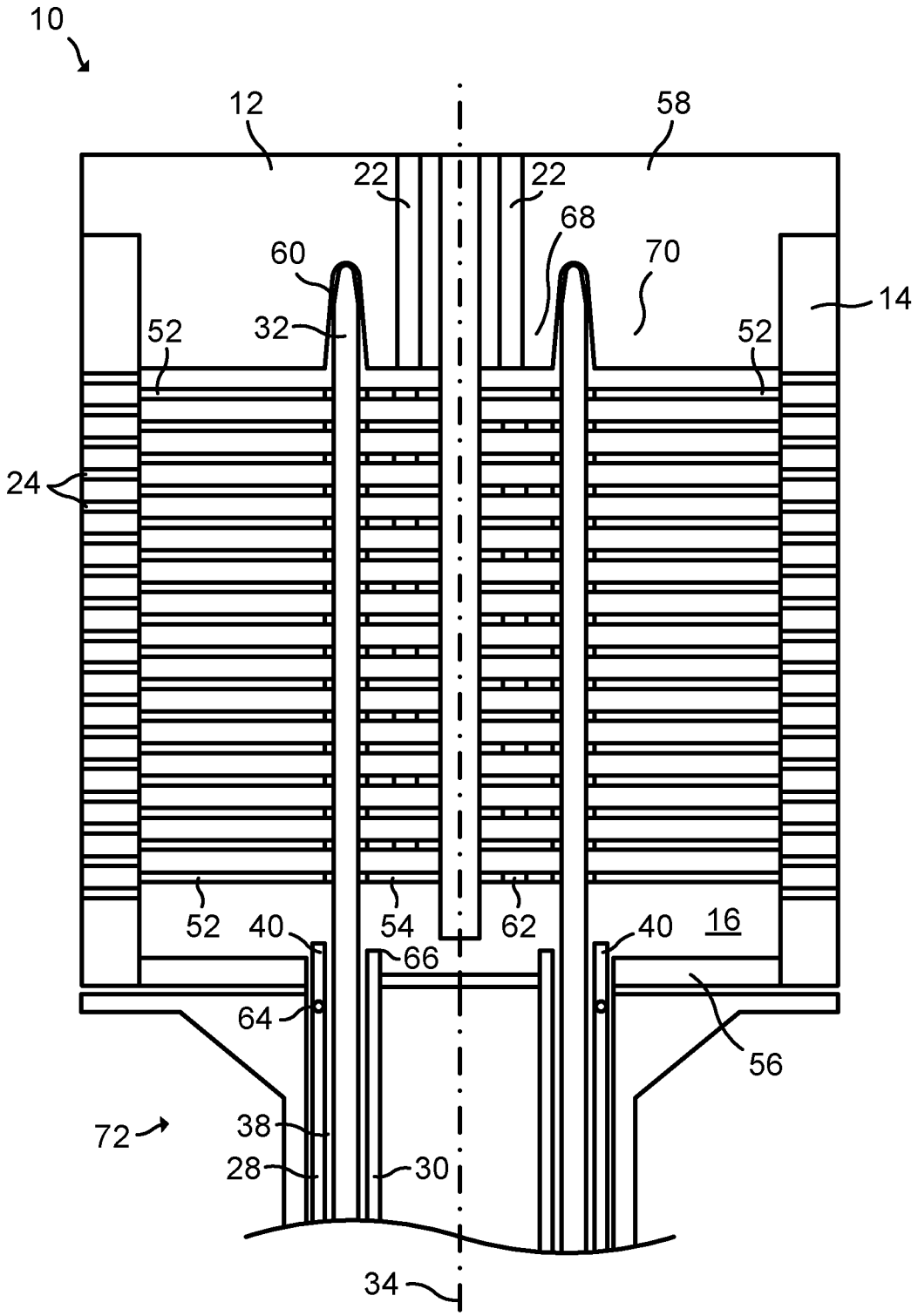
FIG. 5: schematically represents an enlarged partial view of the breaking device in FIG. 2 with the breaking tube in a further protruding position.

FIG. 5 schematically represents an enlarged partial view of the breaking device 10 in FIG. 2 with the breaking tube 32 in a further protruding position 72. In FIG. 5, the breaking tube 32 has moved along the breaking axis 34 past the splitter plates 52, 54 and has been seated against the end section 12.

As shown in FIG. 5, the shape of the slot 60 substantially matches the shape of the tip of the breaking tube 32. Since the slot 60 is formed in the seal 58, the tip of the breaking tube 32 is reliably received in the slot 60 and bouncing of the breaking tube 32 is prevented. When the tip of the breaking tube 32 is received in the slot 60, the arc is chopped and the current is quenched.

The breaking tube 32 may then be returned from the protruding position 72 in FIG. 5 to the starting position 36 for reuse of the breaking device 10. The return movement may for example be made manually or by means of the actuator 42.

The voltage withstand capability of the breaking device 10 mainly depends on the stroke length of the breaking tube 32. The current interruption capability mainly depends on the strength of the breaking tube 32 to withstand the arc pressure. The length of the stroke, the speed of the breaking tube 32, the thickness and length of the breaking tube 32 etc. may be varied depending on implementation.

The breaking device 10 has been prototyped and proven to successfully interrupt DC currents in the ranges of 100 V to 10 kV at currents of 5 A to 6 kA. The prototyping also proved that the breaking device 10 can interrupt current multiple times at voltages of up to 2 kV. Furthermore, the prototyping proved that the arcing chamber 16 can be reduced, both in length and diameter, without any significant change of performance. Furthermore, also prototypes of the breaking device 10 without splitter plates 52, 54 were able to successfully interrupt current.

Figure 6:
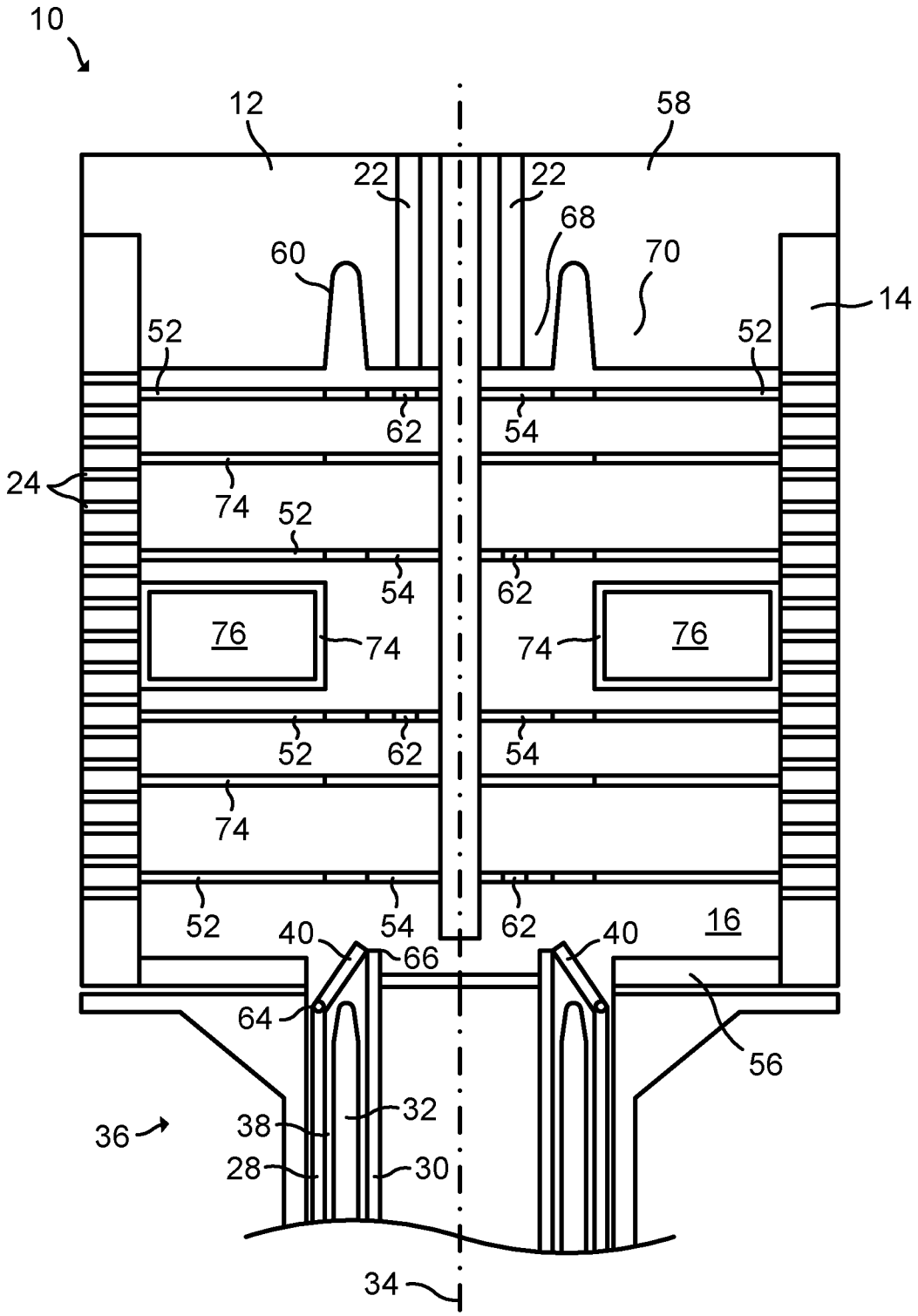
FIG. 6: schematically represents a further example of a breaking device.

FIG. 6 schematically represents a further example of a breaking device 10. Mainly differences with respect to FIGS. 1-5 will be described. The breaking device 10 in FIG. 6 comprises a plurality of outer splitter plates 52, a plurality of inner splitter plates 54, and a plurality of arc cooling bodies 74. Each splitter plate 52, 54 and each arc cooling body 74 constitutes an arc restricting member according to the present disclosure. Each arc cooling body 74 may be located radially outside and/or radially inside the breaking tube 32 when adopting a protruding position 72.

Two of the arc cooling bodies 74 are embodied as plates and two of the arc cooling bodies 74 are embodied as hollow members, comprising arc cooling chambers 76. The function of the arc cooling bodies 74 is to cool down the arc. Each arc cooling body 74 functions as a heat sink since their temperature (even at the melting or evaporation point) is lower than that of the arc. The provision of arc cooling bodies 74 can further improve the performance of the breaking device 10.

Each arc cooling body 74 may be made of a non-metal material such as plastic, ceramic, semiconducting material, or a gas ablating or outgassing material. Examples of outgassing materials are various polymers, such as POM. Further, each arc cooling body 74 may have either linear or non-linear electrical properties.

The arc cooling chambers 76 may comprise vent openings (not illustrated). The arc cooling chambers 76 can thereby function to accumulate pressure waves generated by the arc. In some low voltage implementations, a breaking device 10 comprising only one splitter plate 52, 54 and only one arc cooling body 74 may be sufficient.

Figure 7:
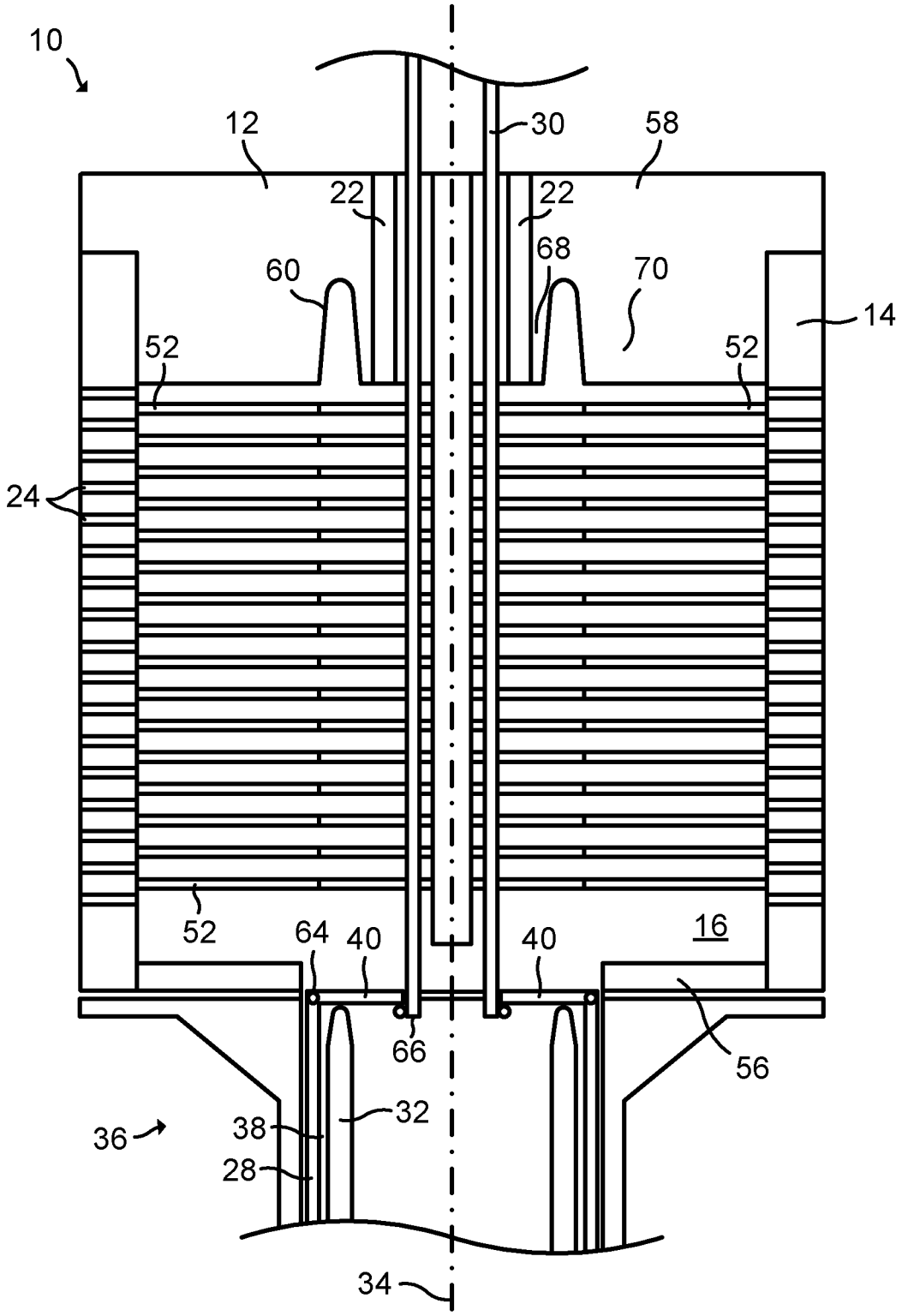
FIG. 7: schematically represents a further example of a breaking device.

FIG. 7 schematically represents a further example of a breaking device 10. Mainly differences with respect to FIGS. 1-6 will be described. Also in FIG. 7, the inner member 30 is arranged radially inside the outer member 28 with respect to the breaking axis 34. However, the inner member 30 extends through the arcing chamber 16 from the opposite side (from above in FIG. 7). Thus, the inner member 30 and the outer member 28 are offset along the breaking axis 34 and the inner member 30 is not arranged within the outer member 28.

Also in the example in FIG. 7, the breaking tube 32 is arranged radially between the outer member 28 and the inner member 30 with respect to the breaking axis 34, and the breaking tube 32 is arranged to move along the breaking axis 34 from the starting position 36 to a protruding position 72 in which the breaking tube 32 protrudes from a space 38 within the outer member 28 for breaking a current between the outer member 28 and the inner member 30 by means of the breaking tube 32.

While the present disclosure has been described with reference to exemplary embodiments, it will be appreciated that the present invention is not limited to what has been described above. For example, it will be appreciated that the dimensions of the parts may be varied as needed.

The invention claimed is:

1. A breaking device for interrupting current, the breaking device comprising:
   - an electrically conducting outer member;
   - an electrically conducting inner member arranged radially inside the outer member with respect to a breaking axis; and
   - an electrically insulating or semiconducting breaking tube arranged radially between the outer member and the inner member with respect to the breaking axis, the breaking tube being arranged to move along the breaking axis from a starting position to a protruding position in which the breaking tube protrudes from a space within the outer member for interrupting a current between the outer member and the inner member by means of the breaking tube.

2. The breaking device according to claim 1, wherein the outer member and/or the inner member is an electrically conducting tube.

3. The breaking device according to claim 2, wherein the outer member, the inner member and the breaking tube are substantially concentric with the breaking axis.

4. The breaking device according to claim 2, further comprising an actuator arranged to force the breaking tube from the starting position to the protruding position.

5. The breaking device according to claim 2, further comprising an arcing chamber, and wherein the breaking tube is arranged to be positioned at least partly inside the arcing chamber in the protruding position.

6. The breaking device according to claim 1, further comprising an actuator arranged to force the breaking tube from the starting position to the protruding position.

7. The breaking device according to claim 1, further comprising an arcing chamber, and wherein the breaking tube is arranged to be positioned at least partly inside the arcing chamber in the protruding position.

8. The breaking device according to claim 7, further comprising at least one arc restricting member arranged within the arcing chamber.

9. The breaking device according to claim 8, wherein the breaking tube is arranged to move past the at least one arc restricting member by moving along the breaking axis from the starting position to the protruding position.

10. The breaking device according to claim 9, wherein the at least one arc restricting member comprises at least one splitter plate and/or at least one arc cooling body.

11. The breaking device according to claim 9, wherein the at least one arc restricting member is positioned radially outside and/or radially inside the breaking tube with respect to the breaking axis when the breaking tube is in the protruding position.

12. The breaking device according to claim 8, wherein the at least one arc restricting member is positioned radially outside and/or radially inside the breaking tube with respect to the breaking axis when the breaking tube is in the protruding position.

13. The breaking device according to claim 12, wherein the at least one arc restricting member comprises at least one splitter plate and/or at least one arc cooling body.

14. The breaking device according to claim 7, wherein the arcing chamber further comprises at least one vent opening for venting a volume within the arcing chamber when the breaking tube has moved from the starting position.

15. The breaking device according to claim 1, further comprising an end section, and wherein the breaking tube is arranged to be seated against the end section in the protruding position.

16. The breaking device according to claim 15, wherein the end section comprises a seal.

17. The breaking device according to claim 15, wherein the end section comprises a slot for receiving the breaking tube in the protruding position.

18. The breaking device according to claim 1, further comprising a contact arrangement configured to selectively electrically disconnect the outer member and the inner member.

19. The breaking device according to claim 18, wherein the contact arrangement is configured to electrically disconnect the outer member and the inner member during movement of the breaking tube from the starting position towards the protruding position.

* * * * *